US009864320B2

(12) United States Patent
Shibuya et al.

(10) Patent No.: US 9,864,320 B2
(45) Date of Patent: Jan. 9, 2018

(54) CLEANING DEVICE AND IMAGE FORMING APPARATUS THEREWITH

(71) Applicant: KYOCERA Document Solutions Inc., Osaka (JP)

(72) Inventors: Teppei Shibuya, Osaka (JP); Ayaka Kurokawa, Osaka (JP); Satoru Nakamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/208,189

(22) Filed: Jul. 12, 2016

(65) Prior Publication Data

US 2017/0023907 A1 Jan. 26, 2017

(30) Foreign Application Priority Data

Jul. 24, 2015 (JP) ..... 2015-147061

(51) Int. Cl.
*G03G 21/00* (2006.01)
*G03G 15/16* (2006.01)

(52) U.S. Cl.
CPC ..... *G03G 21/0011* (2013.01); *G03G 15/161* (2013.01)

(58) Field of Classification Search
CPC . G03G 21/0011; G03G 21/007; G03G 15/161
See application file for complete search history.

(56) References Cited

U.S. PATENT DOCUMENTS

2003/0099480 A1* 5/2003 Nishimura ..... G03G 21/007 399/102
2011/0211883 A1* 9/2011 Ferrar ..... G03G 15/161 399/350
2015/0098726 A1 4/2015 Kobayashi et al. ..... G03G 21/0011
2016/0185036 A1* 6/2016 Yamasaki ..... G03G 21/1832 156/245

FOREIGN PATENT DOCUMENTS

JP 2015-75638 A 4/2015

* cited by examiner

*Primary Examiner* — Carla Therrien
(74) *Attorney, Agent, or Firm* — Stein IP, LLC

(57) ABSTRACT

A cleaning device includes a housing, a cleaning blade, and first and second sealing members. The housing has formed therein an opening facing an image carrying member. The cleaning blade removes toner that remains attached to the image carrying member while being in contact with the circumferential surface of the image carrying member. The first and second sealing members prevent waste toner inside the housing from leaking out through a gap between the housing and the image carrying member, owing to the first and second sealing members abutting on the circumferential surface of the image carrying member.

6 Claims, 3 Drawing Sheets

CLEANING DEVICE AND IMAGE FORMING APPARATUS THEREWITH

INCORPORATION BY REFERENCE

This application is based upon and claims the benefit of priority from the corresponding Japanese Patent Application No. 2015-147061 filed on Jul. 24, 2015, the entire contents of which are incorporated herein by reference.

BACKGROUND

The present disclosure relates to a cleaning device and to an image forming apparatus incorporating the cleaning device. More particularly, the present disclosure relates to a cleaning device that removes toner that remains attached to an image carrying member, and to an image forming apparatus incorporating such a cleaning device.

Conventionally, image forming apparatuses such as copiers and printers incorporate a cleaning device that removes toner that remains attached to an image carrying member such as a photosensitive drum or an intermediate transfer belt. The cleaning device includes a housing having formed in it an opening that faces the image carrying member, and includes a cleaning blade for removing toner that remains attached to the image carrying member while being in contact with the circumferential surface of the image carrying member. On the housing, on the upstream side of the opening with respect to the rotation direction of the image carrying member, a sealing member that abuts on the circumferential surface of the image carrying member is provided for preventing waste toner inside the housing from leaking out through a gap between the housing and the image carrying member.

SUMMARY

According to one aspect of the present disclosure, a cleaning device includes a housing, a cleaning blade, a first sealing member, and a second sealing member. The housing has formed in it an opening that faces an image carrying member and a waste toner storage for storing waste toner scraped off the surface of the image carrying member. The cleaning blade is arranged on the housing, on the downstream side of the opening with respect to the rotation direction of the image carrying member. The cleaning blade removes toner that remains attached to the image carrying member while being in contact with the circumferential surface of the image carrying member with its tip end part pointed to the upstream side with respect to the rotation direction of the image carrying member. The first sealing member is arranged on the housing, on the upstream side of the opening with respect to the rotation direction of the image carrying member. The first sealing member prevents waste toner inside the housing from leaking out through a gap between the housing and the image carrying member, owing to the first sealing member abutting on the circumferential surface of the image carrying member with its tip end part pointed to the downstream side with respect to the rotation direction of the image carrying member. The second sealing member is arranged on the housing, on the upstream side of the opening with respect to the rotation direction of the image carrying member and on the downstream side of the first sealing member with respect to the rotation direction of the image carrying member. The second sealing member prevents waste toner inside the housing from leaking out through a gap between the housing and the image carrying member, owing to the second sealing member abutting on the circumferential surface of the image carrying member with its tip end part pointed to the downstream side with respect to the rotation direction of the image carrying member.

Further features and advantages of the present disclosure will become apparent from the description of embodiments given below.

DETAILED DESCRIPTION

Hereinafter, embodiments of the present disclosure will be described with reference to the accompanying drawings.

<First Embodiment>

Figure 1:
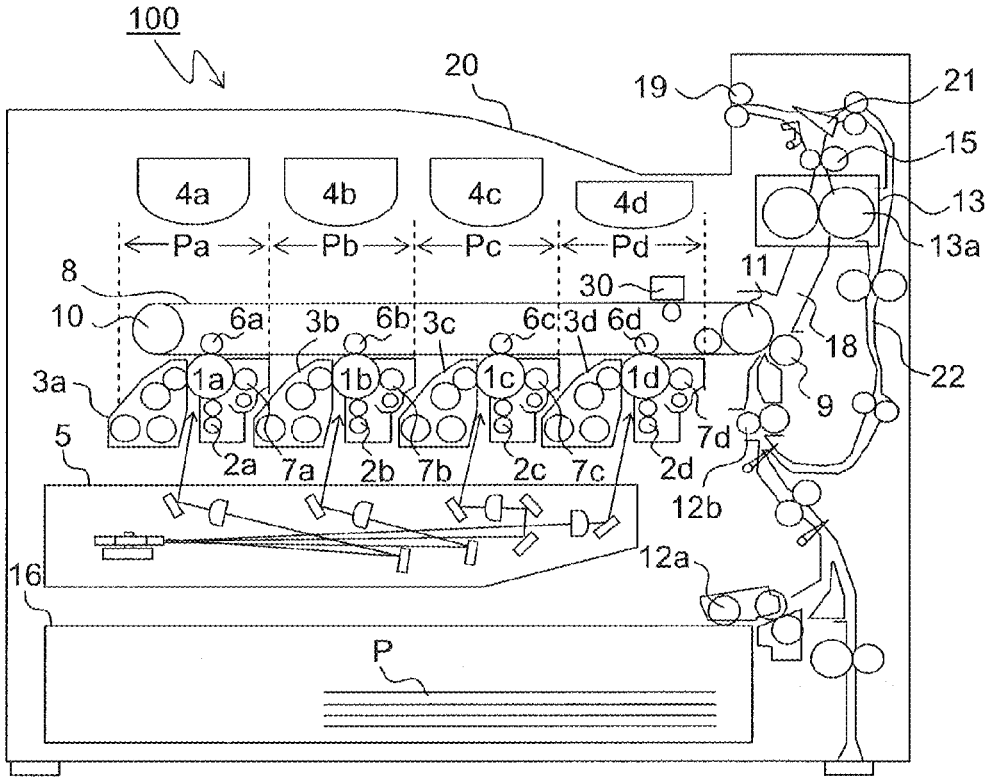
FIG. 1 is a sectional view schematically showing a structure of an image forming apparatus incorporating a belt cleaning device according to a first embodiment of the present disclosure.
Figure 2:
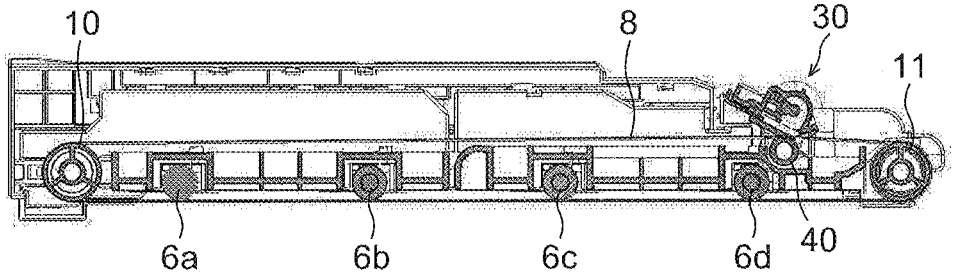
FIG. 2 is a sectional view showing a structure of and around the belt cleaning device according to the first embodiment of the present disclosure and an intermediate transfer belt.
Figure 3:
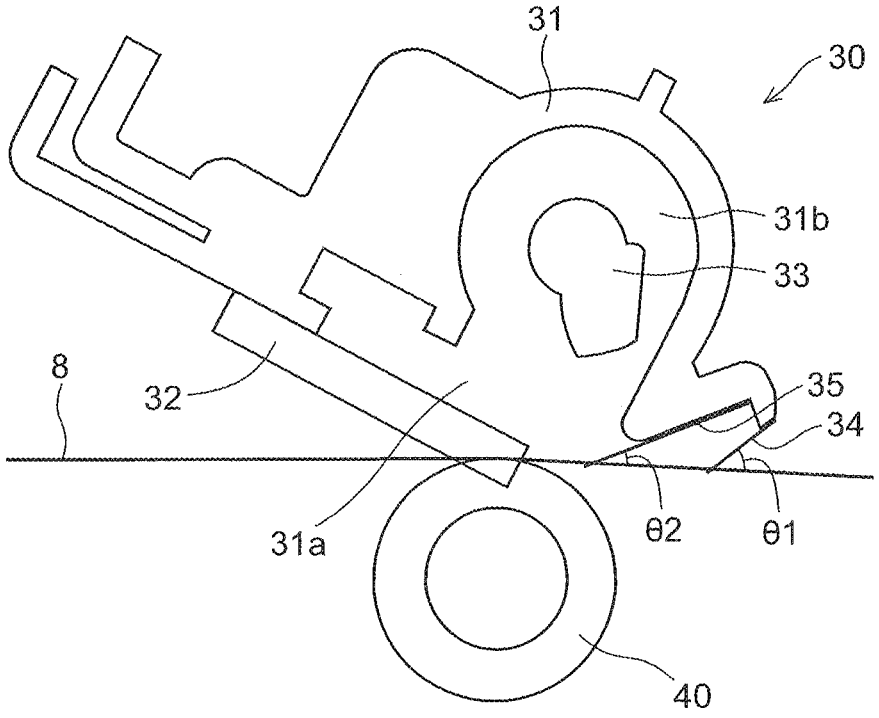
FIG. 3 is a sectional view showing the structure of and around the belt cleaning device according to the first embodiment of the present disclosure.

With reference to FIGS. 1 to 3, an image forming apparatus 100 incorporating a belt cleaning device 30 according to a first embodiment of the present disclosure will be described.

In this embodiment, the image forming apparatus 100 (here a color printer) is a quadruple-tandem-type color printer that performs image formation by use of four photosensitive drums 1*a*, 1*b*, 1*c*, and 1*d*, corresponding to four different colors (yellow, cyan, magenta, and black) respectively, which are arranged side by side.

Inside the apparatus main body of the image forming apparatus 100, four image forming portions Pa, Pb, Pc and Pd are arranged in this order from the left side in FIG. 1. These image forming portions Pa to Pd are provided to correspond to images of four different colors (yellow, cyan, magenta, and black) respectively, and sequentially form yellow, cyan, magenta, and black images respectively, each through the processes of electrostatic charging, exposure to light, image development, and image transfer.

In these image forming portions Pa to Pd are respectively arranged the photosensitive drums 1*a* to 1*d* that carry visible images (toner images) of the different colors. Moreover, an intermediate transfer belt (image carrying member) 8 that rotates in the counter-clockwise direction in FIG. 1 is arranged next to the image forming portions Pa to Pd. Toner images formed on these photosensitive drums 1*a* to 1*d* are sequentially transferred to the intermediate transfer belt 8 that moves while being in contact with the photosensitive drums 1*a* to 1*d*, and then the toner images are transferred all at once to a sheet P as an example of a recording medium by a secondary transfer roller 9. Then, the toner images are fixed to the sheet P in a fixing device 13, and the sheet P is then discharged out of the apparatus main body. An image forming process is performed with respect to each of the photosensitive drums 1*a* to 1*d* while these are rotated in the clockwise direction in FIG. 1.

Sheets P to which toner images are to be transferred are stored in a sheet feed cassette 16 in a lower part of the apparatus, and are transported via a feeding roller 12*a* and a registration roller pair 12*b* to the secondary transfer roller 9. As the intermediate transfer belt 8, a dielectric resin sheet is used, which typically is, for example, a seamless belt having no seam. The intermediate transfer belt 8 and the secondary transfer roller 9 are driven to rotate at the same linear velocity as the photosensitive drums 1*a* to 1*d* by a belt driving motor (unillustrated). In the image forming portion Pd, a belt cleaning device (cleaning device) 30 is arranged for removing toner left unused on the surface of the intermediate transfer belt 8.

Now, the image forming portions Pa to Pd will be described. Around and under the photosensitive drums 1*a* to 1*d*, which are rotatably arranged, there are arranged charging devices 2*a*, 2*b*, 2*c*, and 2*d* for electrostatically charging the photosensitive drums 1*a* to 1*d*, an exposure unit 5 for exposing the photosensitive drums 1*a* to 1*d* to light based on image data, developing units 3*a*, 3*b*, 3*c*, and 3*d* for developing, by use of toner, electrostatic latent images formed on the photosensitive drums 1*a* to 1*d*, and cleaning devices 7*a*, 7*b*, 7*c*, and 7*d* for collecting and removing developer (toner) left unused on the photosensitive drums 1*a* to 1*d* after toner images have been transferred.

When image data is fed in from a host device such as a personal computer, the surfaces of the photosensitive drums 1*a* to 1*d* are first electrostatically charged uniformly by the charging devices 2*a* to 2*d* and are then irradiated with light based on the image data by the exposure unit 5, and thereby electrostatic latent images based on the image data are formed on the photosensitive drums 1*a* to 1*d* respectively. The developing units 3*a* to 3*d* have developing rollers arranged opposite the photosensitive drums 1*a* to 1*d*, and are charged with predetermined amounts of two-component developer containing toner of different colors, namely yellow, cyan, magenta, and black respectively.

When the proportion of toner contained in the two-component developer stored in the developing units 3*a* to 3*d* falls below a predetermined value through formation of toner images, which will be described later, toner is supplied from toner containers 4*a* to 4*d* to the developing units 3*a* to 3*d*. The toner is fed from the developing units 3*a* to 3*d* onto the photosensitive drums 1*a* to 1*d*, and electrostatically attaches to them, thereby forming toner images based on the electrostatic latent images formed by exposure to light from the exposure unit 5.

Then, an electric field is applied, by primary transfer rollers 6*a* to 6*d*, between the primary transfer rollers 6*a* to 6*d* and the photosensitive drums 1*a* to 1*d* with a predetermined transfer voltage, and the yellow, cyan, magenta, and black toner images on the photosensitive drums 1*a* to 1*d* are primarily transferred to the intermediate transfer belt 8. These images of four colors are formed in a predetermined positional relationship prescribed to form a predetermined full-color image. Thereafter, in preparation for subsequent formation of new electrostatic latent images, toner left unused on the surfaces of the photosensitive drums 1*a* to 1*d* is removed by the cleaning devices 7*a* to 7*d*.

The intermediate transfer belt 8 is wound around a following roller 10 and a driving roller 11. As the driving roller 11 rotates by being driven by the above-mentioned belt driving motor, the intermediate transfer belt 8 rotates in the counter-clockwise direction; meanwhile, a sheet P is transported from the registration roller pair 12*b*, with predetermined timing, to a nip (secondary transfer nip) between the secondary transfer roller 9, which is arranged next to the intermediate transfer belt 8, and the intermediate transfer belt 8. At the nip, the full-color image is secondarily transferred to the sheet P. The sheet P having the toner images transferred to it is transported to the fixing device 13.

The sheet P transported to the fixing device 13 is heated and pressed while passing through a fixing nip between a fixing roller pair 13*a* composed of a heating roller and a pressing roller, and thereby the toner images are fixed to the surface of the sheet P to form the predetermined full-color image. The sheet P having the full-color image formed on it is, via a transport roller pair 15, distributed between different transport directions by a branching member 21 arranged in a branching portion of a sheet transport passage 18. The sheet P is then, as it is (or after being transported to a double-sided transport passage 22 and being subjected to double-sided copying), discharged via a discharge roller pair 19 onto a discharge tray 20.

Specifically, the sheet transport passage 18 branches into left and right passages on the downstream side of the transport roller pair 15. Of these passages, one (the passage that branches in the leftward direction in FIG. 1) communicates with the discharge tray 20, while the other (the passage that branches in the rightward direction in FIG. 1) communicates with the double-sided transport passage 22. When images are formed on both sides of the sheet P, a part of the sheet P having passed through the fixing device 13 is momentarily stuck out of the apparatus via the discharge roller pair 19.

Thereafter, the discharge roller pair 19 is rotated in the reverse direction and the branching member 21 is swung to be substantially horizontal, so that the sheet P is guided, along the top surface of the branching member 21, to the double-sided transport passage 22. The sheet P is then, with the image side reversed, transported once again to the secondary transfer roller 9. Then, the next image formed on the intermediate transfer belt 8 is transferred by the secondary transfer roller 9 to the side of the sheet P on which no image has yet been formed. The sheet P is then transported to the fixing device 13, where the toner image is fixed, and is then discharged onto the discharge tray 20.

Next, the structure of and around the belt cleaning device 30 will be described.

As shown in FIG. 2, the belt cleaning device 30 is arranged on the downstream side of the driving roller 11 with respect to the rotation direction of the intermediate transfer belt 8 and on the upstream side of the following roller 10 with respect to the rotation direction of the intermediate transfer belt 8. As shown in FIG. 3, the belt cleaning device 30 includes a housing 31, a cleaning blade 32, a collection screw 33, and first and second sealing members 34 and 35 each in the form of a sheet.

The housing 31 has an opening 31*a* facing the intermediate transfer belt 8, and has a waste toner storage 31*b* for storing waste toner scraped off the surface of the intermediate transfer belt 8.

The cleaning blade 32 is fixed to the housing 31, on the downstream side (on the left side in FIG. 3) of the opening 31*a* with respect to the rotation direction of the intermediate transfer belt 8. The cleaning blade 32 abuts on the circumferential surface of the intermediate transfer belt 8 to remove toner that remains attached to the intermediate transfer belt 8. As the cleaning blade 32, for example, a blade made of polyurethane rubber is used. The cleaning blade 32 is fitted at a predetermined angle such that its tip end part points to the upstream side with respect to the rotation direction of the intermediate transfer belt 8. The material, hardness, and dimensions of the cleaning blade 32, the depth and pressing force with which the cleaning blade 32 is pressed onto the intermediate transfer belt 8, etc., can be adjusted as necessary according to the specifications of the intermediate transfer belt 8.

At a position facing the cleaning blade 32 across the intermediate transfer belt 8, there is arranged a cleaning counter roller 40 that receives a pressing force from the cleaning blade 32. The cleaning counter roller 40 is driven to rotate in the counter-clockwise direction in FIG. 3 at the same linear velocity as the intermediate transfer belt 8 by a driving force from the same driving source as the driving roller 11 (from the belt driving motor). The vertex (topmost part) of the cleaning counter roller 40 is arranged at a position slightly higher than the vertex of the driving roller 11 and the vertex of the following roller 10.

The unused toner removed from the surface of the intermediate transfer belt 8 by the cleaning blade 32 is, as the collection screw 33 rotates, discharged out of the belt cleaning device 30 and transported to a toner collection container (unillustrated) to be stored in it.

The first sealing member 34 is fitted to the housing 31, on the upstream side (on the right side in FIG. 3) of the opening 31*a* with respect to the rotation direction of the intermediate transfer belt 8. One end part (the right end in FIG. 3) of the first sealing member 34 is bonded to the housing 31, and the other end part (the left end in FIG. 3) forms a free end. The free end of the first sealing member 34, while pointing to the downstream side with respect to the rotation direction of the intermediate transfer belt 8, abuts on the circumferential surface of the intermediate transfer belt 8. The first sealing member 34 serves to prevent waste toner inside the housing 31 from leaking out through a gap between the housing 31 and the intermediate transfer belt 8. As the first sealing member 34, for example, a urethane sheet with a thickness of 100 μm is used; instead, any sheet in the shape of a thin plate other than the urethane sheet may be used.

The second sealing member 35 is fitted to the housing 31, on the upstream side (on the right side in FIG. 3) of the opening 31*a* with respect to the rotation direction of the intermediate transfer belt 8 and on the downstream side (on the left side in FIG. 3) of the first sealing member 34 with respect to the rotation direction of the intermediate transfer belt 8. One end part (the right end in FIG. 3) of the second sealing member 35 is bonded to the housing 31, and the other end part (the left end in FIG. 3) forms a free end. The free end of the second sealing member 35, while pointing to the downstream side with respect to the rotation direction of the intermediate transfer belt 8, abuts on the circumferential surface of the intermediate transfer belt 8. The second sealing member 35 serves to prevent waste toner inside the housing 31 from leaking out through a gap between the housing 31 and the intermediate transfer belt 8. As the second sealing member 35, for example, a urethane sheet with a thickness of 100 μm is used; instead, any sheet in the shape of a thin plate other than the urethane sheet may be used.

Now, in this embodiment, let the inclination angle of the first sealing member 34 with respect to the circumferential surface of the intermediate transfer belt 8 be θ1, and let the inclination angle of the second sealing member 35 with respect to the circumferential surface of the intermediate transfer belt 8 be θ2, then θ1>θ2 holds. Specifically, the inclination angle θ1 satisfies 30°<θ1<90°, and the inclination angle θ2 satisfies 10°<θ2<40°. In this embodiment, the first and second sealing members 34 and 35 have substantially equal rigidity, surface roughness, and friction coefficients.

In this embodiment, as described above, on the housing 31 are provided, on the upstream side of the opening 31*a* with respect to the rotation direction of the intermediate transfer belt 8, the first and second sealing members 34 and 35 that prevent, by abutting on the circumferential surface of the intermediate transfer belt 8, waste toner inside the housing 31 from leaking out through a gap between the housing 31 and the intermediate transfer belt 8. That is, two sealing members are provided along the rotation direction of the intermediate transfer belt 8. Thus, water toner inside the housing 31 can be prevented from leaking out through a gap between the housing 31 and the intermediate transfer belt 8.

As described above, let the inclination angle of the first sealing member 34 with respect to the circumferential surface of the intermediate transfer belt 8 be θ1, and let the inclination angle of the second sealing member 35 with respect to the circumferential surface of the intermediate transfer belt 8 be θ2, then θ1>θ2 holds. This permits paper dust or the like to stay at a place where the first sealing member 34 and the intermediate transfer belt 8 are in contact with each other, and also prevents paper dust or the like from staying at a place where the second sealing member 35 and the intermediate transfer belt 8 are in contact with each other, so as to thereby prevent a tip end part of the second sealing member 35 from leaving the circumferential surface of the intermediate transfer belt 8. Thus, with the second sealing member 35, it is possible to achieve sealing and thereby effectively prevent waste toner inside the housing 31 from leaking.

As described above, the inclination angle θ1 satisfies 30°<θ1<90°, and the inclination angle θ2 satisfies 10°<θ2<40°. This permits paper dust or the like to easily stay at the place where the first sealing member 34 and the intermediate transfer belt 8 are in contact with each other, and thus with the second sealing member 35, it is possible to achieve sealing easily.

<Second Embodiment>

As a second embodiment, a description will be given of a case where the present disclosure is applied to the cleaning devices 7*a* to 7*d* that remove toner that remains attached to the photosensitive drums (image carrying members) 1*a* to 1*d*. Although the following description deals with, as an example, a structure of and around the photosensitive drum 1*a*, the cleaning devices 7*b* to 7*d* that remove toner attached to the photosensitive drums 1*b* to 1*d* have basically the same structure, and thus no overlapping description will be repeated.

Figure 4:
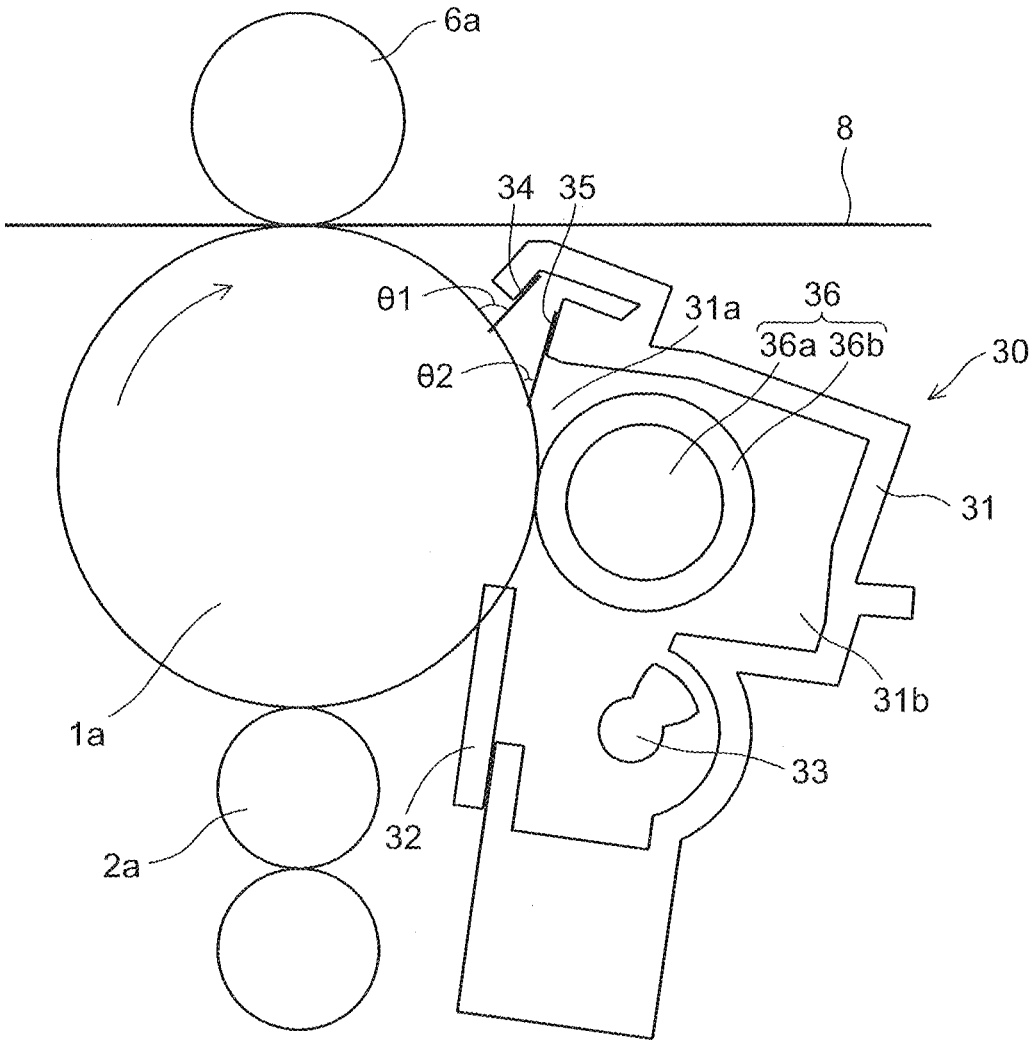
FIG. 4 is a sectional view showing a structure of and around a cleaning device according to a second embodiment of the present disclosure.

As shown in FIG. 4, the cleaning device 7*a* is arranged on the downstream side of the primary transfer roller 6*a* with respect to the rotation direction of the photosensitive drum 1*a* and on the upstream side of the charging device 2*a* with respect to the rotation direction of the photosensitive drum 1*a*. The cleaning device 7*a* includes the housing 31, the cleaning blade 32, the collection screw 33, and the first and second sealing members 34 and 35 each in the form of a sheet, and further includes a cleaning brush 36.

The cleaning brush 36 performs a scratching process in which it scratches off toner that remains attached to the surface of the photosensitive drum 1*a* after primary transfer, as a preparatory process to permit the cleaning blade 32 to effectively scrape off the unused toner. The cleaning brush 36 is formed in the shape of a brush with a large number of brush fibers 36*b* arranged erect radially from the circumferential surface of a rotary shaft 36*a* which is arranged parallel to the rotary shaft of the photosensitive drum 1*a*. The cleaning brush 36 is driven to rotate by an unillustrated driving means in the same direction (the counter-clockwise direction) as the photosensitive drum 1*a* at the plane of contact with it so as to transport toner toward the downstream side with respect to the rotation direction (the clockwise direction) of the photosensitive drum 1*a*, that is, toward the side where the collection screw 33 is arranged.

In this embodiment, as in the previously-described first embodiment, let the inclination angle of the first sealing member 34 with respect to the circumferential surface of the photosensitive drum 1*a* be θ1, and let the inclination angle of the second sealing member 35 with respect to the circumferential surface of the photosensitive drum 1 a be θ2, then θ1>θ2 holds. The inclination angle θ1 satisfies 30°<θ1<90°, and the inclination angle θ2 satisfies 10°<θ2 <40°.

Otherwise, the structure and effects in the second embodiment are similar to those in the previously-described first embodiment.

It should be understood that the embodiments disclosed herein are in every aspect illustrative and not restrictive. The scope of the present disclosure is defined not by the description of embodiments given above but by the appended claims, and encompasses many modifications and variations made in the sense and scope equivalent to those of the claims.

For example, although an example has been dealt with in which the present disclosure is applied to a color printer, this is not meant as any limitation. Needless to say, the present disclosure is applicable to various image forming apparatuses provided with a cleaning device that removes toner that remains attached to an image carrying member, examples including monochrome printers, color copiers, monochrome copiers, digital multifunction peripherals, facsimile machines, etc.

Although the above-described embodiments deal with an example where the first and second sealing members 34 and 35 are arranged such that θ1>θ2 holds, this is in no way meant to limit the present disclosure. For example, the first and second sealing members 34 and 35 may be arranged such that θ1≤θ2 holds.

Although the above-described embodiments deal with an example where the first and second sealing members 34 and 35 are arranged such that θ1>θ2 so that the first sealing member 34 makes paper dust or the like stay and that the second sealing member 35 achieves sealing, this is in no way meant to limit the present disclosure. For example, the first and second sealing members 34 and 35 may be arranged such that θ1=θ2 holds, and the first sealing member 34 may be given higher rigidity than the second sealing member 35. Also with this configuration, it is possible to permit paper dust or the like to stay at a place where the first sealing member 34 and an image carrying member (the intermediate transfer belt 8, the photosensitive drums 1*a* to 1*d*) are in contact with each other, and in addition to prevent paper dust or the like from staying at a place where the second sealing member 35 and the image carrying member are in contact with each other, so as to thereby prevent a tip end part of the second sealing member 35 from leaving the circumferential surface of the image carrying member. Thus, with the second sealing member 35, it is possible to achieve sealing and thereby effectively prevent waste toner inside the housing 31 from leaking.

Or, for example, the first and second sealing members 34 and 35 may be arranged such that θ1=θ2 holds, and the first sealing member 34 may be given smaller surface roughness than the second sealing member 35 on their respective surfaces which abut on the image carrying member. In this case, the first sealing member 34 has a higher coefficient of friction than the second sealing member 35 on their respective surfaces which abut on the image carrying member. Also with this configuration, it is possible to permit paper dust or the like to stay at a place where the first sealing member 34 and the image carrying member are in contact with each other, and in addition to prevent paper dust or the like from staying at a place where the second sealing member 35 and the image carrying member are in contact with each other, so as to thereby prevent a tip end part of the second sealing member 35 from leaving the circumferential surface of the image carrying member. Thus, with the second sealing member 35, it is possible to achieve sealing and thereby effectively prevent waste toner inside the housing 31 from leaking.

Although the above-described second embodiment deals with an example where a cleaning device according to the present disclosure is used for removing toner left unused on the surface of the photosensitive drum 1*a* of a color printer, this is in no way meant to limit the present disclosure. Paper dust is more likely to attach to the surface of the photosensitive drum 1*a* in image forming apparatuses such as monochrome printers and monochrome copiers in which a toner image is transferred to a sheet P directly from the photosensitive drum 1*a* without first being transferred to an intermediate transfer belt (intermediate transfer member). Thus, when a cleaning device according to the present disclosure is used for the purpose of removing toner left unused on the surface of the photosensitive drum 1*a*, it is more effective to incorporate it in monochrome image forming apparatuses than in color image forming apparatuses.

The technical scope of the present disclosure encompasses any structure obtained by combining together different features from the above-described embodiments and modified examples as necessary.

What is claimed is:

1. A cleaning device comprising:

a housing having formed therein an opening that faces an image carrying member; and a waste toner storage for storing waste toner scraped off a surface of the image carrying member;

a cleaning blade arranged on the housing, on a downstream side of the opening with respect to a rotation direction of the image carrying member, the cleaning blade removing toner that remains attached to the image carrying member while being in contact with a circumferential surface of the image carrying member with a tip end part of the cleaning blade pointed upstream with respect to the rotation direction of the image carrying member;

a first sealing member arranged on the housing, on an upstream side of the opening with respect to the rotation direction of the image carrying member, the first sealing member preventing waste toner inside the housing from leaking out through a gap between the housing and the image carrying member, owing to the first sealing member abutting on the circumferential surface of the image carrying member with a tip end part of the first sealing member pointed downstream with respect to the rotation direction of the image carrying member; and a second sealing member arranged on the housing, on the upstream side of the opening with respect to the rotation direction of the image carrying member and on a downstream side of the first sealing member with respect to the rotation direction of the image carrying member, the second sealing member preventing waste toner inside the housing from leaking out through a gap between the housing and the image carrying member, owing to the second sealing member abutting on the circumferential surface of the image carrying member with a tip end part of the second sealing member pointed downstream with respect to the rotation direction of the image carrying member, wherein the second sealing member is a sheet in a shape of a thin plate, and the entire second sealing member is arranged on an upstream side of the cleaning blade with respect to the rotation direction of the image carrying member.

2. The cleaning device of claim 1, wherein let an inclination angle of the first sealing member with respect to the circumferential surface of the image carrying member be $\theta 1$, and let an inclination angle of the second sealing member with respect to the circumferential surface of the image carrying member be $\theta 2$, then $\theta 1 > \theta 2$ holds.

3. The cleaning device of claim 2, wherein the inclination angle $\theta 1$ satisfies $30° < \theta 1 < 90°$, and the inclination angle $\theta 2$ satisfies $10° < \theta 2 < 40°$.

4. The cleaning device of claim 1, wherein the first sealing member has higher rigidity than the second sealing member.

5. The cleaning device of claim 1, wherein the first sealing member has smaller surface roughness than the second sealing member on respective surfaces thereof which abut on the image carrying member.

6. An image forming apparatus comprising the cleaning device of claim 1.

* * * * *